US009187230B2

(12) United States Patent
Liao et al.

(10) Patent No.: US 9,187,230 B2
(45) Date of Patent: Nov. 17, 2015

(54) PACKING BAG WITH CUSHIONING FUNCTION

(75) Inventors: Yaw-Shin Liao, New Taipei (TW); Wan-Cih Jian, New Taipei (TW)

(73) Assignees: AIR-BAG PACKAGING CO., LTD., New Taipei (TW); Yaw-Shin Liao, New Taipei (TW)

( * ) Notice: Subject to any disclaimer, the term of this patent is extended or adjusted under 35 U.S.C. 154(b) by 409 days.

(21) Appl. No.: 13/605,901

(22) Filed: Sep. 6, 2012

(65) Prior Publication Data

US 2013/0313152 A1 Nov. 28, 2013

(30) Foreign Application Priority Data

May 25, 2012 (TW) ..... 101118776 A

(51) Int. Cl.
*B65D 81/02* (2006.01)
*B65D 81/05* (2006.01)

(52) U.S. Cl.
CPC ..... *B65D 81/052* (2013.01)

(58) Field of Classification Search
CPC ..... B65D 81/052
USPC ..... 206/522, 590–594; 229/67.1, 67.4, 229/68.1, 76, 77, 147; 383/3, 78, 81–84, 86
See application file for complete search history.

(56) References Cited

U.S. PATENT DOCUMENTS 1,519,813 A * 12/1924 Scott ..... 229/147
1,551,268 A * 8/1925 Scott ..... 229/147
3,806,024 A 4/1974 Marchesani
4,465,188 A * 8/1984 Soroka et al. ..... 206/522
4,574,953 A * 3/1986 Garbuzov ..... 206/522
6,149,002 A * 11/2000 Tiramani et al. ..... 206/592
6,415,920 B1 * 7/2002 Tiramani et al. ..... 206/592
7,013,589 B2 * 3/2006 Dickinson et al. ..... 40/312
7,066,331 B2 * 6/2006 Koyanagi et al. ..... 206/522
7,410,057 B2 * 8/2008 Yoshifusa ..... 206/522
2004/0149618 A1 8/2004 Otaki et al.
2004/0171469 A1 * 9/2004 Brandolini et al. ..... 229/68.1
2009/0050509 A1 2/2009 Liao
2009/0127153 A1 * 5/2009 Kim ..... 206/522
2011/0049001 A1 * 3/2011 Won ..... 206/522

FOREIGN PATENT DOCUMENTS

JP 56175346 12/1981
JP 3052657 U 9/1998
JP 2009161245 A 7/2009

* cited by examiner

*Primary Examiner* — Luan K Bui
(74) *Attorney, Agent, or Firm* — Muncy, Geissler, Olds & Lowe, P.C.

(57) ABSTRACT

A packing bag with a cushioning function includes: a first cushioning air cylinder portion, constituted by air cylinders; a second cushioning air cylinder portion, constituted by air cylinders, and coupled to the first cushioning air cylinder portion to form an accepting space; and a binding belt, coupled to the first cushioning air cylinder portion and/or the second cushioning air cylinder portion, and used for sealing an opening of the accepting space. The first cushioning air cylinder portion and second air cylinder portion constituted by the air cylinders can perform the cushioning protection of an object effectively, solving the problem of the shock-absorption capability insufficiency of the conventional small air sacs, solving the problem of the conventional small air sacs being insufficient in shock-absorption capability. In addition, the binding belt not only allows a label to be attached thereon, but also avoids the air cylinder being pierced through.

4 Claims, 19 Drawing Sheets

PACKING BAG WITH CUSHIONING FUNCTION

CROSS-REFERENCES TO RELATED APPLICATIONS

This non-provisional application claims priority under 35 U.S.C. §119(a) on Patent Application No(s). 101118776 filed in Taiwan, R.O.C. on May 25, 2012, the entire contents of which are hereby incorporated by reference.

TECHNICAL FIELD

The present invention relates to a packing bag, and more particularly to a packing bag with a cushioning function.

BACKGROUND

Generally, a letter or object is placed in an envelope, mail receiver and sender information is written or printed on the front of the envelope, and the envelope is then sealed by using glue or other ways. However, general envelopes have been used for a long time without changing a lot; they are only changed a little in style, for example, a metal fixing sheet or cotton winding fastener may be added in a seal structure of a envelope, or a self adhesive glue is attached on an envelope seal. Therefore, a conventional envelope cannot be adjusted with a different content.

For the cushioning protection of a content, the content will first be wrapped in a plastic film with a plurality of small air sacs and then placed in an envelope, or the plastic film with a plurality of air sacs is laid in the envelope in advance and the content is then placed in the envelope, thereby avoiding the damage of the content due to a direct impact through the cushioning protection of the small air sacs. However, the shock-absorptive capability of the small air sacs is limited; they cannot achieve cushioning shock-absorption with respect to a larger impact load. Obviously, a precise object needing a more perfect protection during transportation cannot mailed with this kind of package.

SUMMARY

To solve the above technological problems, the present invention provides a packing bag with a cushioning function, which has a good cushioning effect.

The packing bag with a cushioning function includes:

a first cushioning air cylinder portion, constituted by a plurality of air cylinders;

a second cushioning air cylinder portion, constituted by a plurality of air cylinders, coupled to the first cushioning air cylinder portion to form an accepting space used for receiving an object, a upper joint position of the first cushioning air cylinder portion and the second cushioning air cylinder portion being not sealed, forming a natural opening used as a placement entrance for the object; and a binding belt, coupled to the first cushioning air cylinder portion and/or the second cushioning air cylinder portion, and used for sealing the placement entrance of the accepting space and thus closing the opening.

Furthermore, the first cushioning air cylinder portion includes a first fixation side and a first opening side, where the first opening side is positioned at the opening of the accepting space, and the first fixation side is positioned at one end of the first cushioning air cylinder portion opposite to the first opening side.

Furthermore, the second cushioning air cylinder portion includes a second fixation side and a second opening side, where the second opening side is positioned at the opening of the accepting space, and the second fixation side is positioned at one end of the second cushioning air cylinder portion opposite to the second opening side, where the second fixation side and the first fixation are coupled to each other securely.

Furthermore, one end of the second cushioning air cylinder portion adjacent to the second opening side is in air communication with the first cushioning air cylinder portion, and another end of the second cushioning air cylinder portion adjacent to second opening side is coupled to another end of the first cushioning air cylinder portion securely.

Furthermore, the binding belt is provided with a plane to which a label can be attached, and can cover the opening and wrap a packed object by binding it tightly; the binding belt can be used to seal the opening by means of tight binding not matter that the object and the size of the accepting space are well matched. Therefore, the binding belt may be an independent plastic sheet or an independent sheet composed of the plastic sheet and other material, or formed by a non-inflatable zone extended from the cushioning air cylinder portion, the binding belt includes:

a fixation end, coupled to the first fixation side;

a positioning end, secured to the second cushioning air cylinder portion, thereby sealing the opening of the accepting space;

Furthermore, the positioning end is configured with a sticking element, used for securing the positioning end on the second cushioning air cylinder portion.

Furthermore, the binding belt includes:

a fixation end, coupled to the second fixation side; and a positioning end, secured to the first cushioning air cylinder portion, thereby sealing the opening of the accepting space.

Furthermore, the positioning end is configured with a sticking element, used for securing the positioning end on the first cushioning air cylinder portion.

Furthermore, when the number of the binding belt is more than one, the left sides and right sides of the two binding belts among them are respectively stuck to each other and not coupled to the first cushioning air cylinder portion and second cushioning air cylinder portion, and the bottoms thereof are stuck to bottoms of the first cushioning air cylinder portion and second cushioning air cylinder portion, forming a loose bag wrapping the first cushioning air cylinder portion and second air cylinder portion, the third binding belt includes a fixation end and a positioning end, the fixation end is coupled to the first fixation side or the second fixation side, and the positioning end may be secured to the bag, thereby sealing the opening of the accepting space.

Furthermore, the length and width of the binding belt may all be adjusted depending on the area size of the cushioning air cylinder portion.

Furthermore, the material of the binding belt may be PE combined with other different material such as paper, pearl cotton foam, cloth, or cardboard.

Furthermore, the binding belt is a plastic sheet, and a plane itself, where the plane can be attached with a variety of labels, thereby facilitating sticking mail receiver information.

Furthermore, at least one air valve device is further included, used the filling air into the first cushioning air cylinder portion and second cushioning air cylinder portion.

Furthermore, the air valve device is a single-sheet type check valve or a continuous check valve.

Furthermore, an air filling passageway is further included; the air filling passageway is in air communication with the first cushioning air cylinder portion and second cushioning air cylinder portion through the air valve device. Thereupon, the independent single-way check valve can close the air inlet after the air storable air cylinder is filled with air, thereby allowing the first cushioning air cylinder portion and second cushioning air cylinder portion to have a cushioning function.

Furthermore, the first cushioning air cylinder portion and second cushioning air cylinder portion is formed by sticking two sheets of outer film by means of hot sealing after being stacked together.

Furthermore, the binding belt may be formed by coupling another sheet of plastic film to the first cushioning air cylinder portion or second cushioning air cylinder portion;

Or, formed by configuring a non-inflatable zone on the packing bag.

Furthermore, an inflatable zone and a non-inflatable zone are configured on the first cushioning air cylinder portion and second cushioning air cylinder portion, where inflatable zone is formed into the first cushioning air cylinder portion and the second cushioning air cylinder portion, and a plastic outer film in the non-inflatable zone is cut apart to form two independent binding belts, respectively corresponding to the first cushioning air cylinder portion and second cushioning air cylinder portion.

Furthermore, the binding belt can be constituted by two sheets of plastic film, the two sheets of plastic film are stuck to each other at the left and right side of the cushioning portions, and stuck to the two the cushioning portions at the bottom opposite to the placement opening.

BRIEF DESCRIPTION OF THE DRAWINGS

The present invention can be more fully understood by reference to the following description and accompanying drawings, in which.

DETAILED DESCRIPTION

A packing bag 1 with a cushioning function of the present invention includes:

a first cushioning air cylinder portion 3, constituted by a plurality of air cylinders;

a second air cylinder portion 4, constituted by a plurality of air cylinders, and coupled to the first cushioning air cylinder portion 3 to form an accepting space for receiving an object; and a binding belt 8, coupled to the first cushioning air cylinder portion 3 and/or the second air cylinder portion 4, and used for covering an opening of the accepting space.

Figure 1:
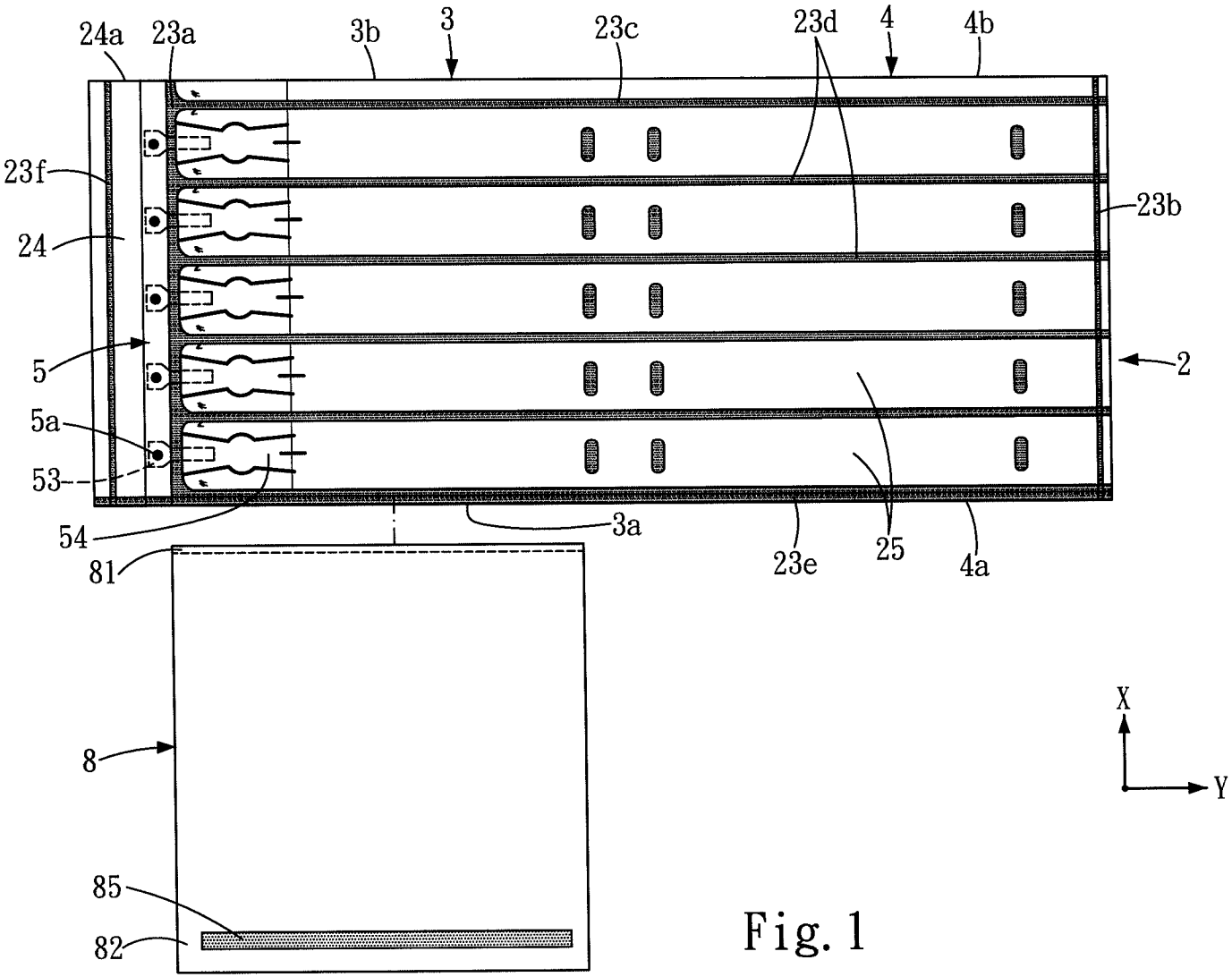
FIG. 1 is a schematic view of the first preferred embodiment of the present invention.

A first outer film 21 and a second outer film 22 are stuck to each other by means of hot sealing to form an air cylinder sheet 2, the first and second outer films are stacked together vertically and may be formed with hot sealing lines 23*a*, 23*b*, 23*c*, 23*d*, 23*e* by means of hot sealing, and thus formed into the air cylinder sheet 2 having a plurality of air cylinders 25, which are divided into the first cushioning air cylinder portion 3 and the second cushioning air cylinder portion 4 in air communication with each other as FIG. 1 shows. The plurality of air cylinders are configured adjacently to each other in sequence in an arrangement direction X, and the plurality of air cylinders are divided into the first cushioning air cylinder portion 3 and second cushioning air cylinder portion 4 in a longitudinal direction Y thereof such that one end of the cushioning air cylinder portion 3 is in air communication with the second cushioning air cylinder portion 4.

The first cushioning air cylinder portion 3 and second cushioning air cylinder portion 4 constituted by the plurality of air cylinders can protect a packed object with an effective cushioning ability during transportation, solving the problems caused from the insufficient shock-absorbing ability of the conventional small air sacs.

In the present embodiment, the first cushioning air cylinder portion 3 has a first fixation side 3*a* and a first opening side 3*b*, and the first fixation side 3*a* and the first opening side 3*b* are positioned at the two ends of the first cushioning air cylinder portion 3 in the direction X along which the air cylinders 25 are arranged. Furthermore, the second cushioning air cylinder portion 4 has a fixation side 4*a* and a second opening side 4*b*, and the second fixation side 4*a* and the second opening side 4*b* are positioned at the two ends of the second cushioning air cylinder portion 4 in the arrangement direction X along which the air cylinders are configured.

Figure 2:
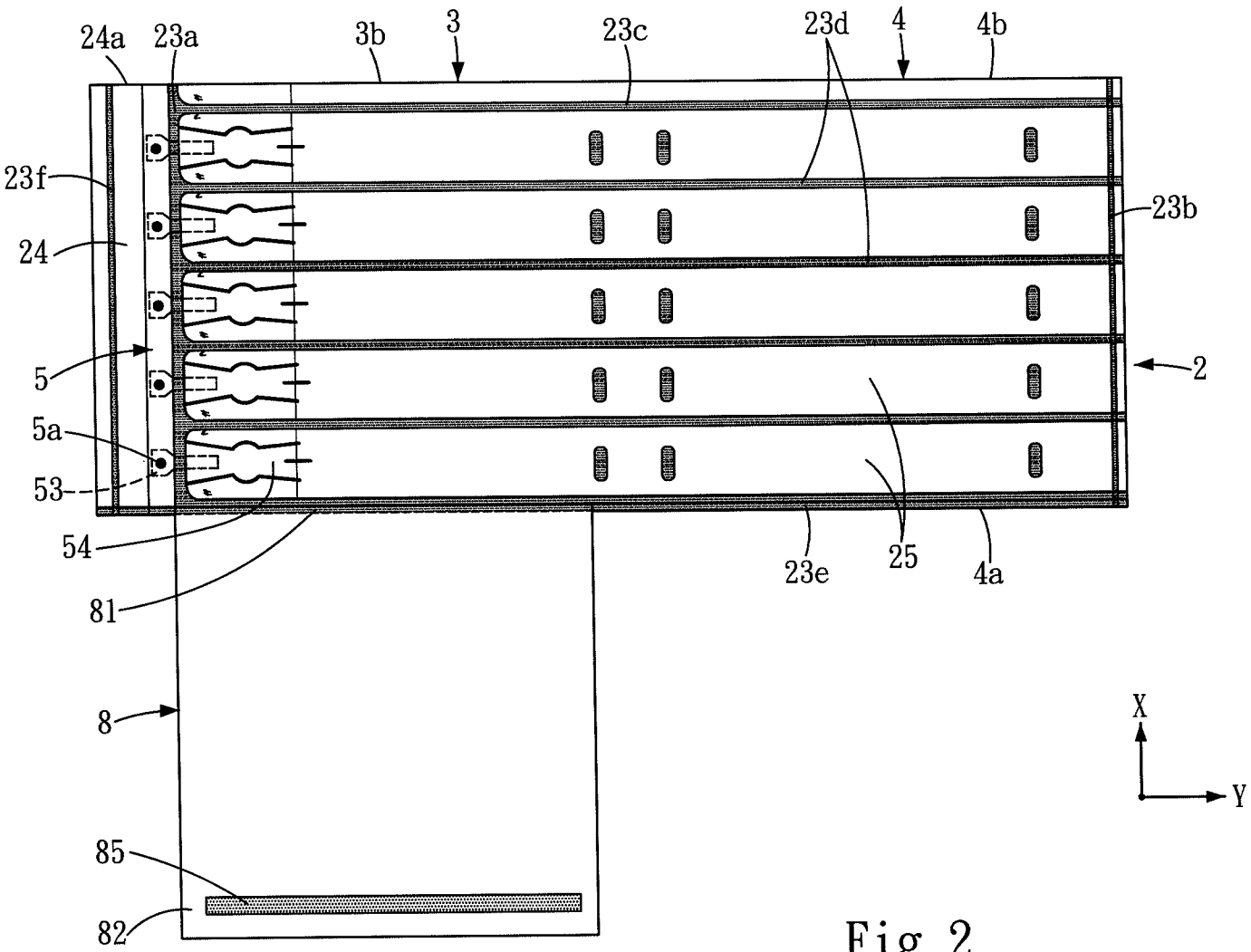
FIG. 2 is another schematic view of the first preferred embodiment of the present invention.

Please refer to FIGS. 1 and 2, in which the binding belt 8 has a fixation end 81 and a positioning end 82, where the fixation end 81 is fixed to the first fixation side 3*a* of the first cushioning air cylinder portion 3.

The length and width of the binding belt 8 may be set according to a practical need. The length of the binding belt 8 is not shorter than the length of the first cushioning air cylinder portion 3 in the direction X along which the air cylinders 25 are arranged.

In the present embodiment, the binding belt 8 has the same length as the first cushioning air cylinder portion 3 in the direction X along which the air cylinders 25 arranged. The first outer film 21, second outer film 22 and binding belt 8, which all have the same length, are used to form a packing bag; the manufacture thereof is rather easy.

In the present embodiment, the width of the binding belt 8 is not larger than the length of the first cushioning air cylinder portion 3 in the direction Y along which the air cylinders 25 are extended, allowing it to be eye-appealing and cost-saving.

The binding belt 8, first outer film 21 and second outer film 22, a first inner film 51 and second inner film 52 may be formed of a thermally activated hot-sealable material such as polyester, Polyethylene polypropylene copolymer, Polyethylene terephthalate (PET), ethylene ethyl acetate (EVA), polypropylene (PP), nylon (Nylon), and PE composite membrane, biodegradable material (biodegradable materials), the polymer material coated paper, or the like, capable of preventing the air cylinder 25 from being pierced through.

To further prevent the air cylinder 25 from being pierced through, the binding belt 8 may also be formed of other strengthening materials.

To be waterproof, the binding belt 8 may also formed of other waterproof materials.

In addition, the binding belt 8 is configured with a sticking element on the positioning end 82 thereof. The sticking element may be adhesive, a Velcro fastener, or the like, but the present invention is not so limited.

Figure 3:
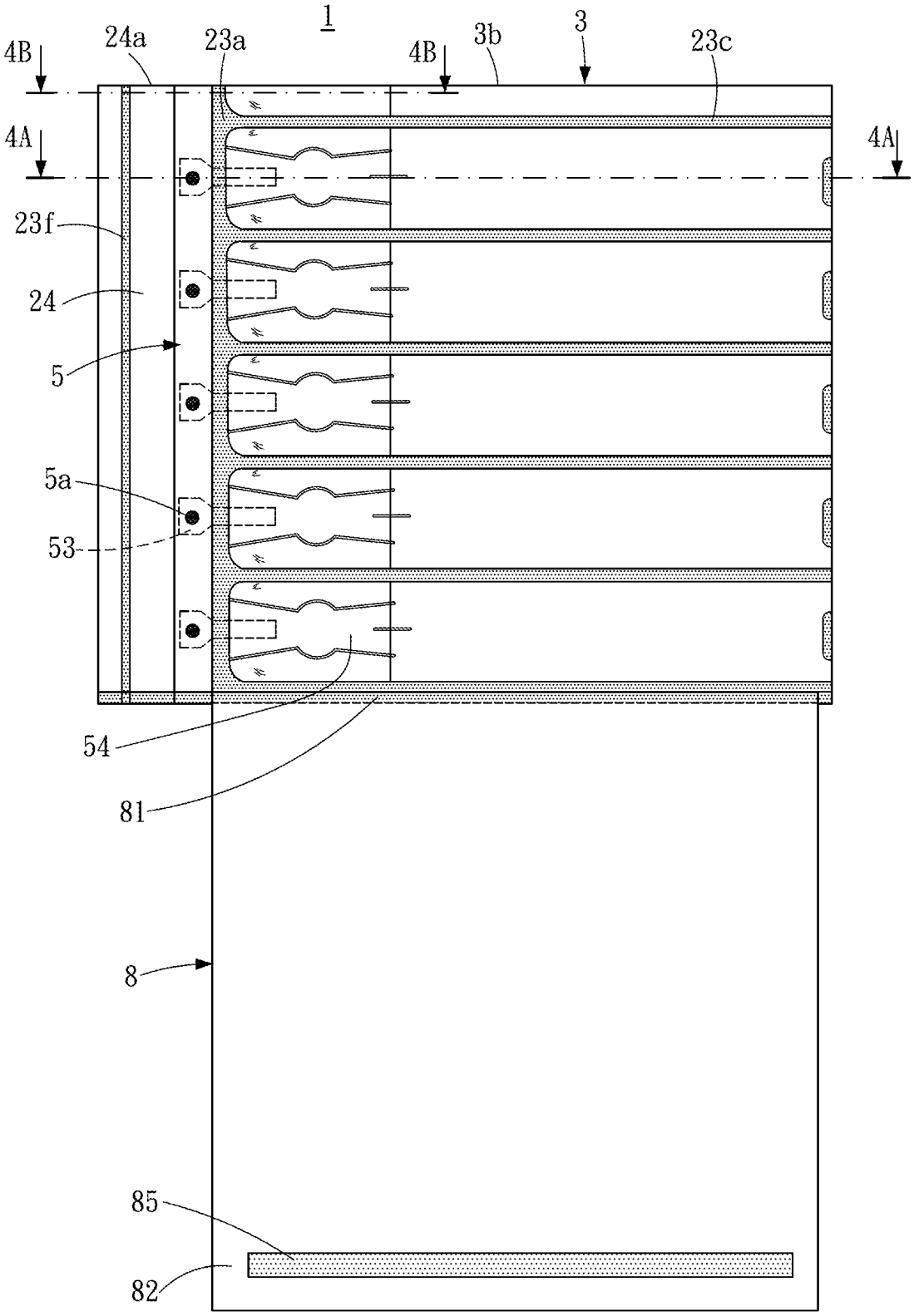
FIG. 3 is still another schematic view of a first preferred embodiment of the present invention.
Figure 4A:
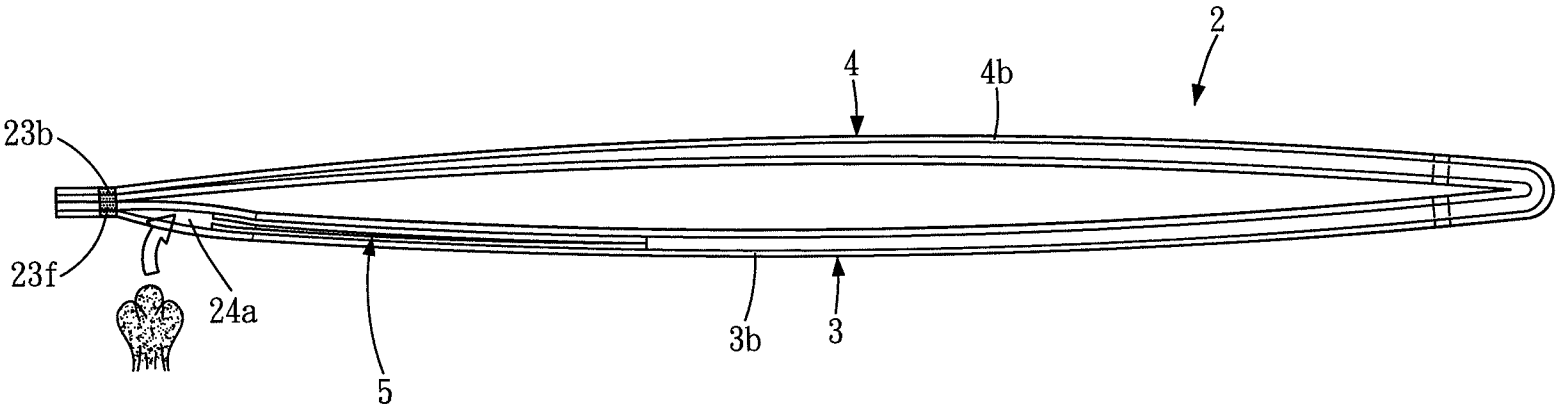
FIG. 4A is a cross-sectional view taken along line 4A-4A of FIG. 3.

Please refer to FIGS. 3 and 4A, in which the first cushioning air cylinder portion 3 is bended to stack with the second cushioning air cylinder portion 4 together, the first cushioning air cylinder portion 3 is thereafter stuck to the second cushioning air cylinder portion 4 by means hot sealing at their unconnected sides, and the first fixation side 3*a* is finally stuck to the second fixation side 4*a* by means of hot sealing, causing them to be connected and secured to each other, thereby forming a an accepting space for receiving an object between the first and second cushioning air cylinder portions. Consequently, the first opening side 3*b* and second opening side 4*b* wall into an opening 20 of the accepting space.

Figure 4B:
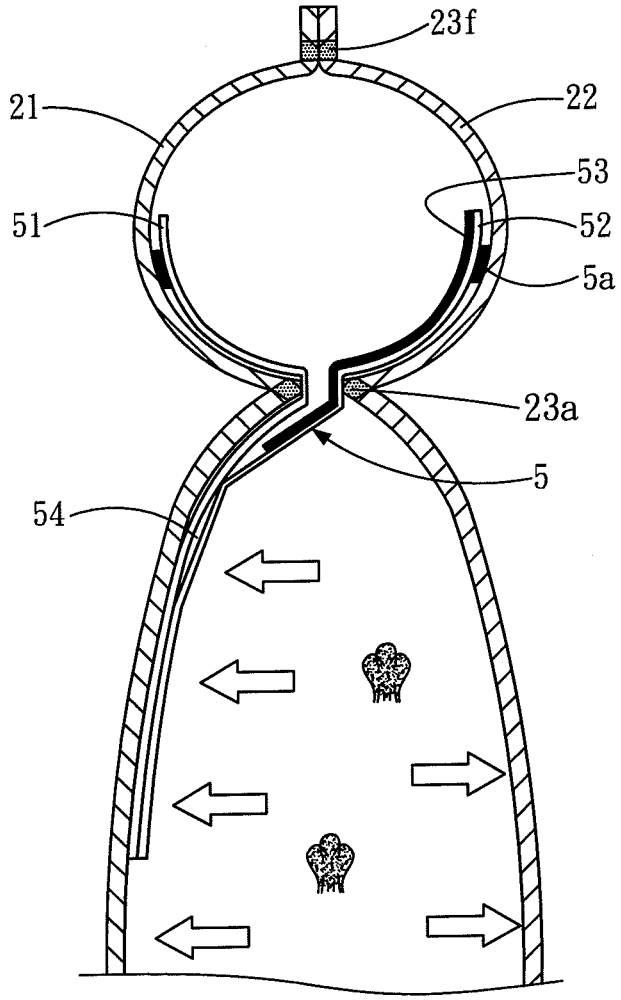
FIG. 4B is a cross-sectional view taken along line 4B-4B of FIG. 3.
Figure 5:
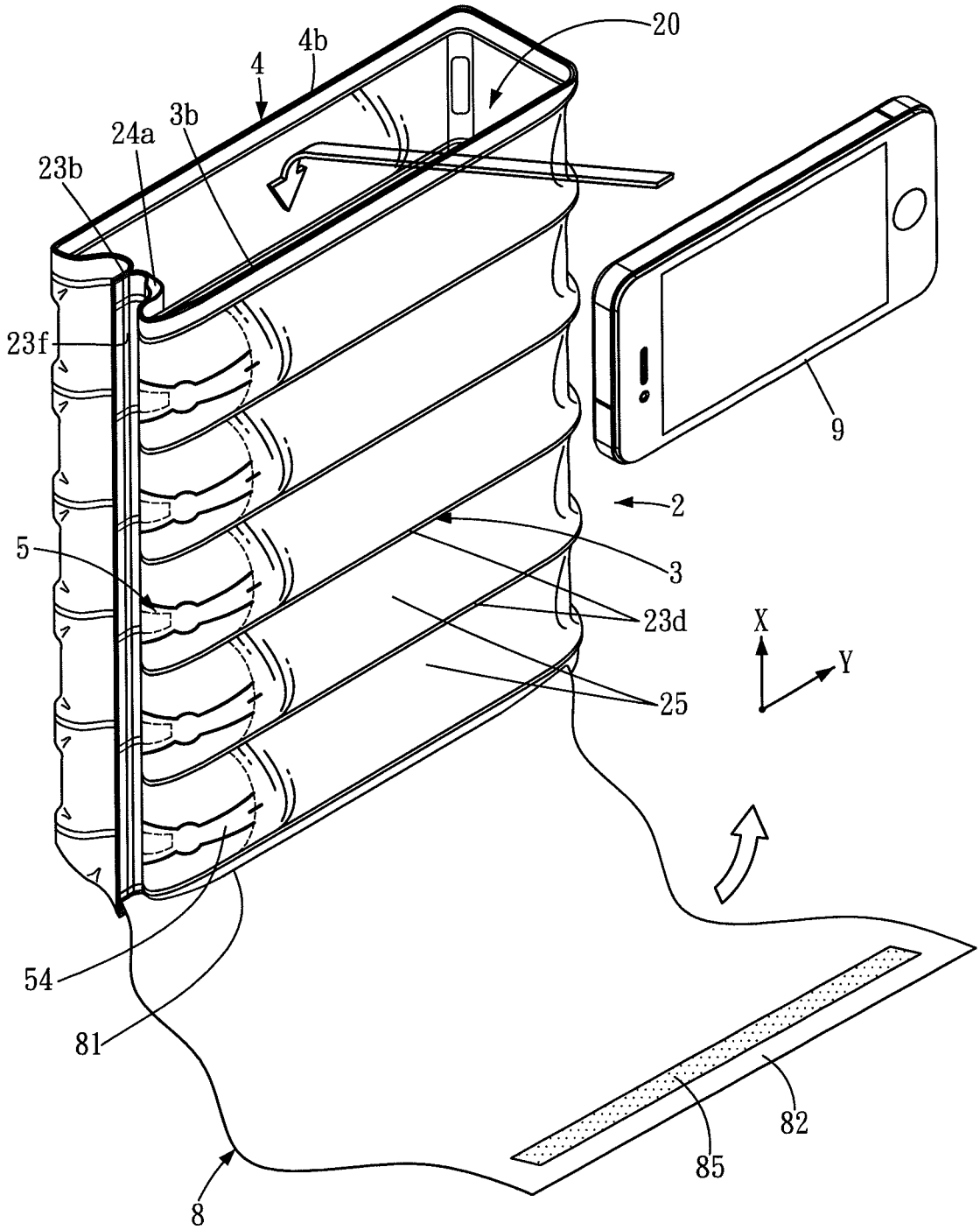
FIG. 5 is a perspective view of the first embodiment of the present while an object is received.
Figure 6:
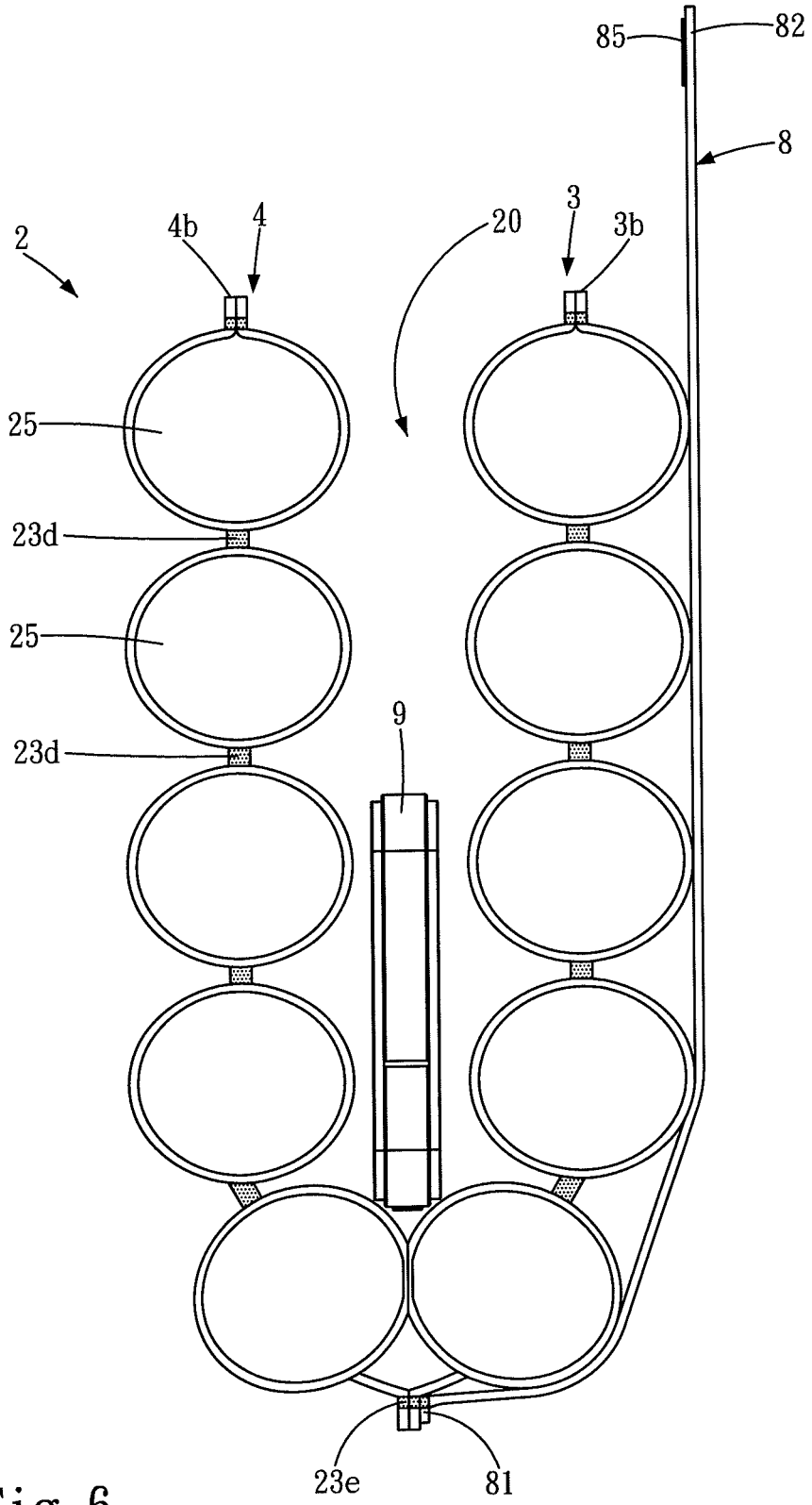
FIG. 6 is a lateral view of the first embodiment of the present while an object is being received.
Figure 7:
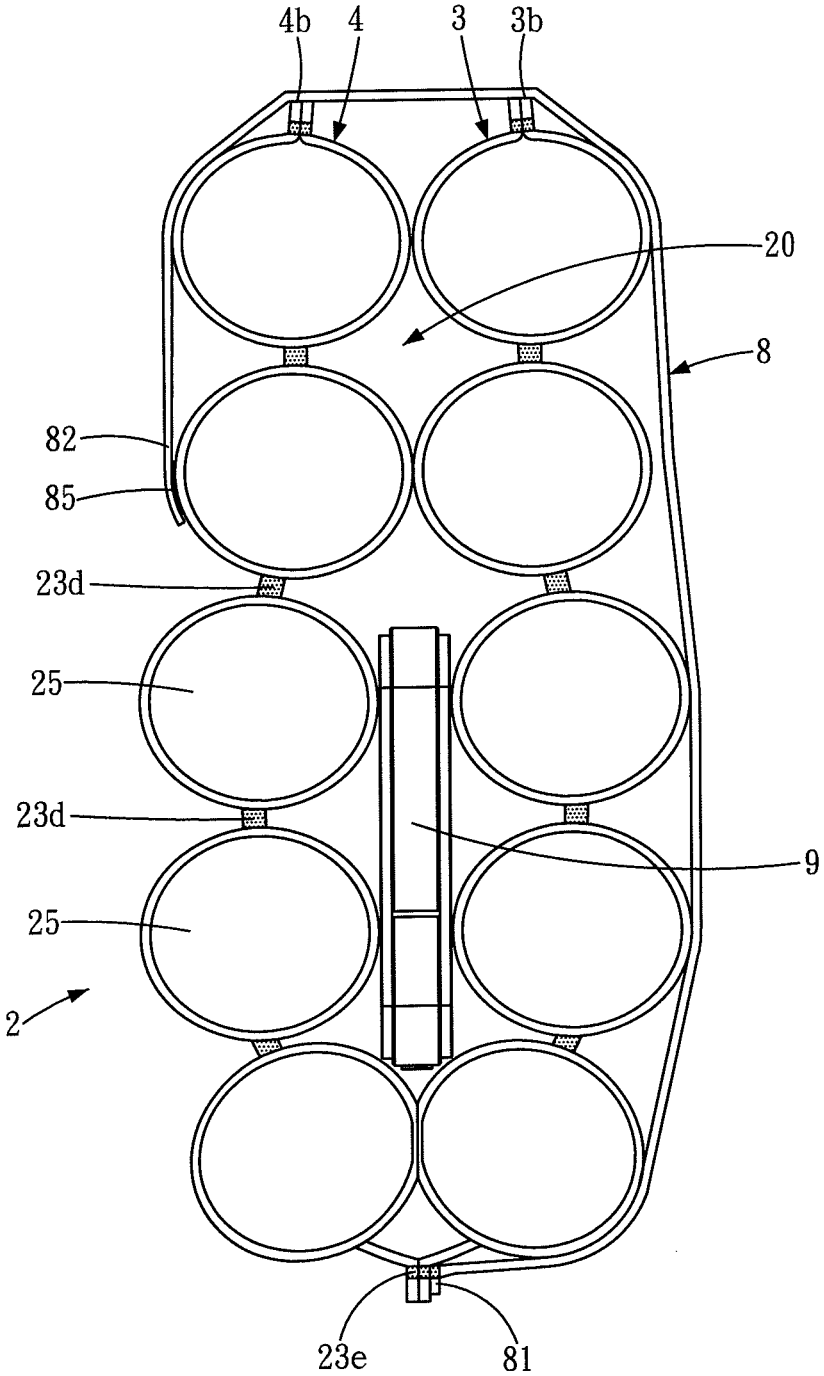
FIG. 7 is a lateral view of the first embodiment of the present invention when an opening is sealed.

Please refer to FIG. 4B, in which the air cylinders 25 of the first cushioning air cylinder portion 3 and the second cushioning air cylinder portion 4 are filled with air and expanded after the air cylinder sheet 2 is filled with air by means of the air filling mentioned above; they are filled with air and expanded from a stacked-sheet type body in a state without air filling as FIG. 3 shows to a three-dimensional type body in an air-filling expansion state as FIG. 5 shows. In another word, the first outer film 21 and the second outer film 22 are pulled apart outward to form the three-dimensional type body due to the air filling and expansion, causing the first cushioning air cylinder portion 3 and second cushioning air cylinder portion 4 to be shrunk in length in the arrangement direction X. Because the binding belt 8 is a sheet structure, the length thereof is not changed after the air cylinder sheet 2 is filled with air and expanded, but also because the first cushioning air cylinder portion 3 and second cushioning air cylinder portion 4 are shortened in the arrangement direction, causing the length of the binding belt 8 to be larger than the length of the first cushioning air cylinder portion 3 or second cushioning air cylinder portion 4 in an air-filling expansion state.

Figure 8:
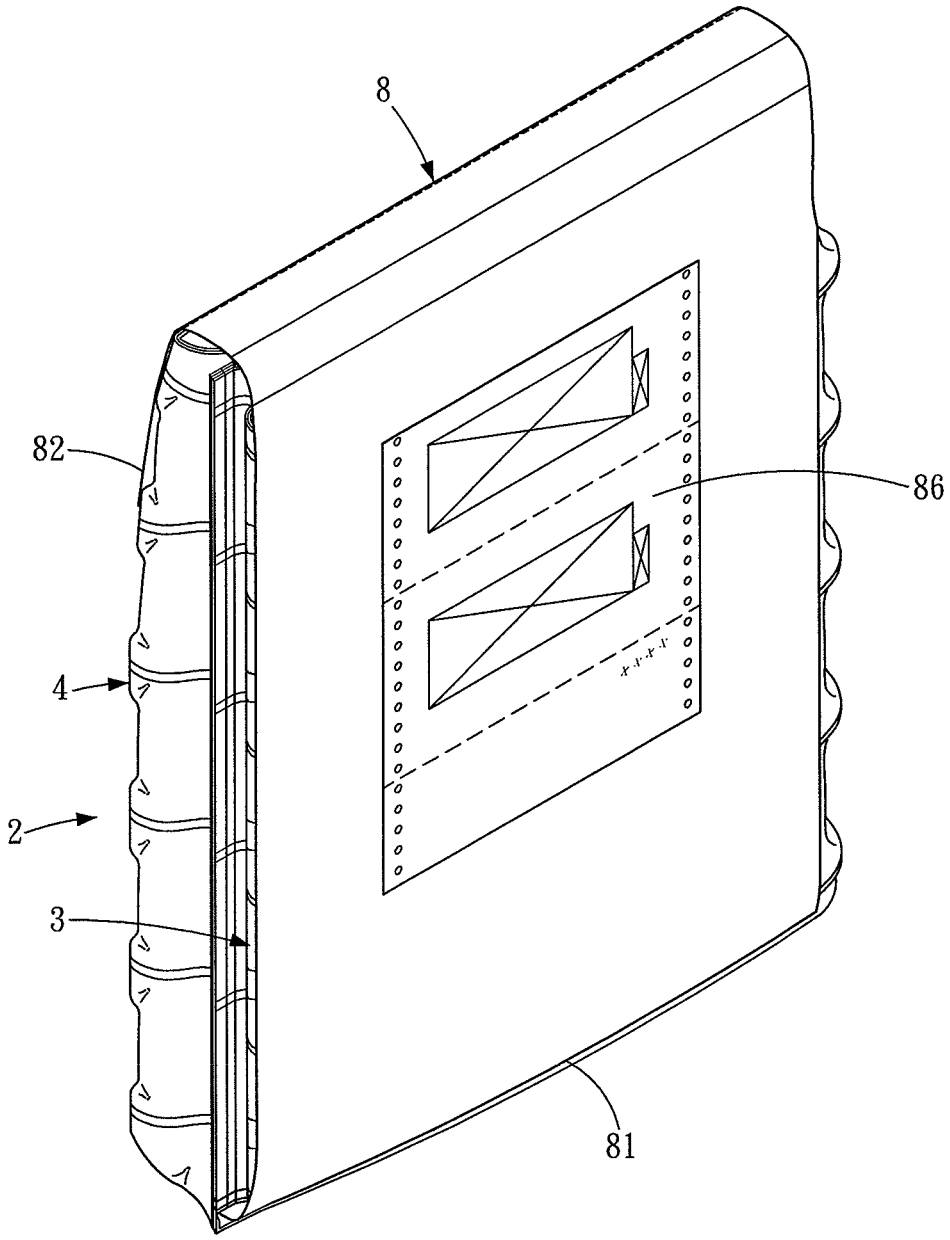
FIG. 8 is a perspective view of the first embodiment of the present invention with a label attached thereon.
Figure 9A:
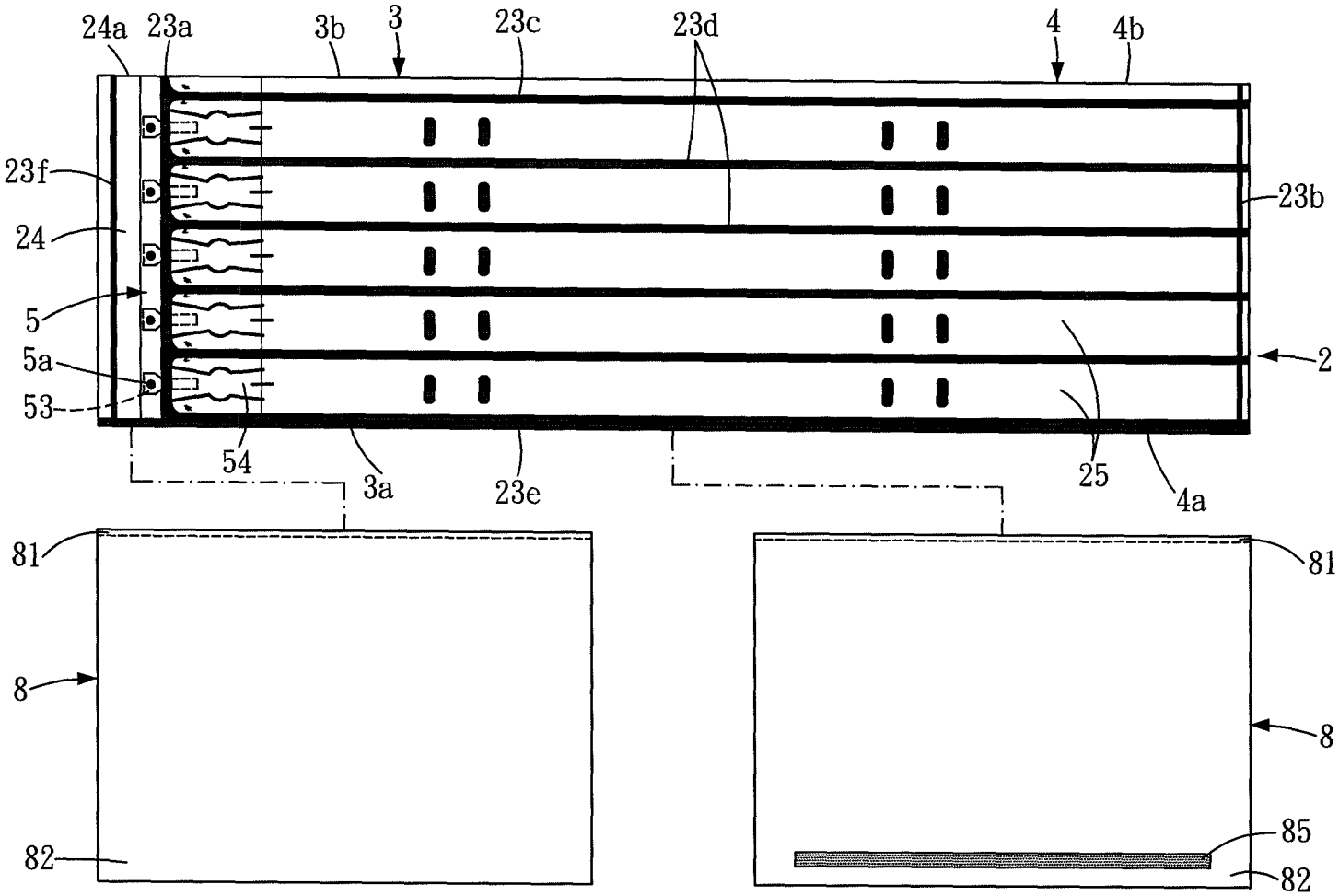
FIG. 9A is a schematic view of a second preferred embodiment according to the present invention.
Figure 9B:
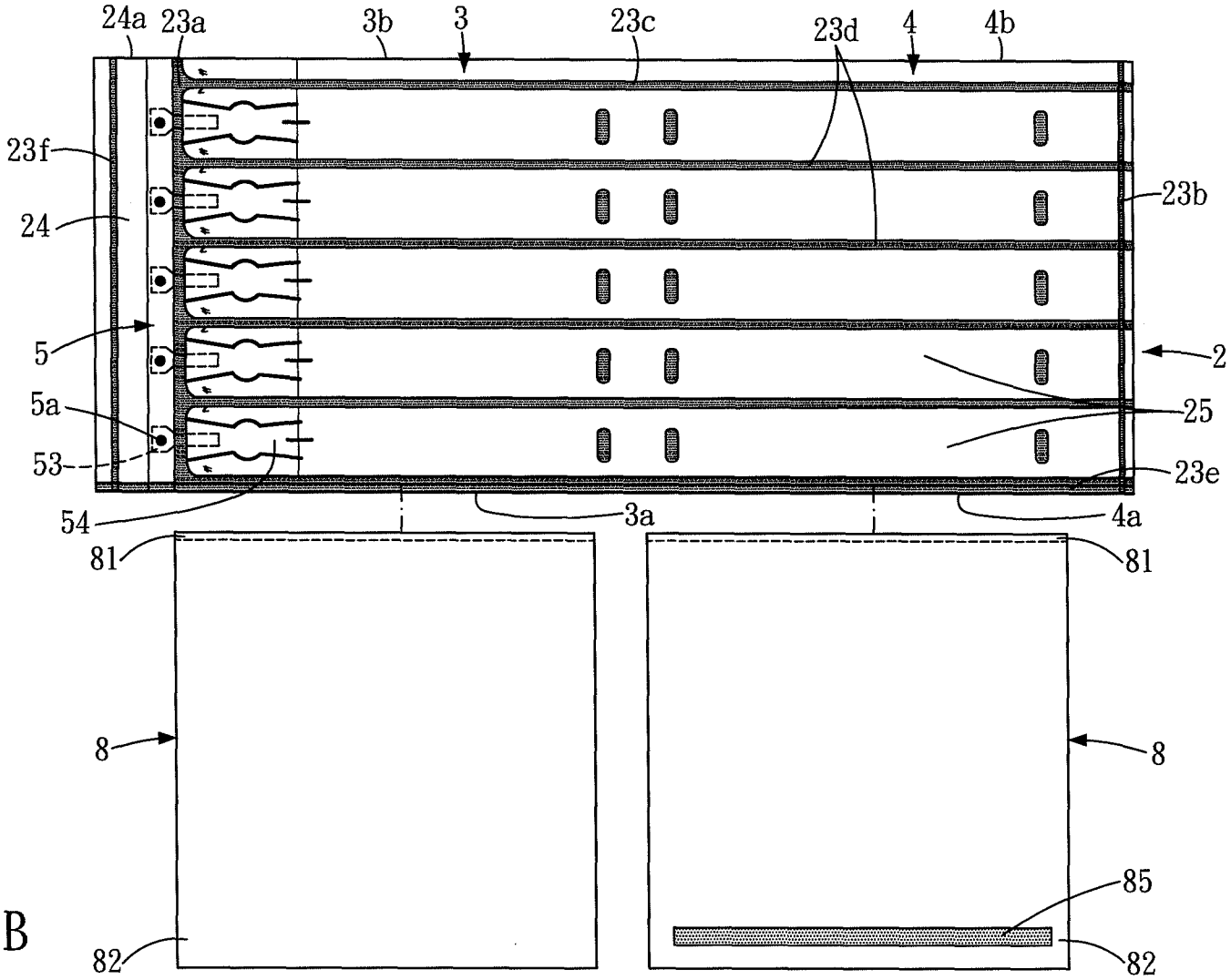
FIG. 9B is another schematic view of a second preferred embodiment according to the present invention.
Figure 10:
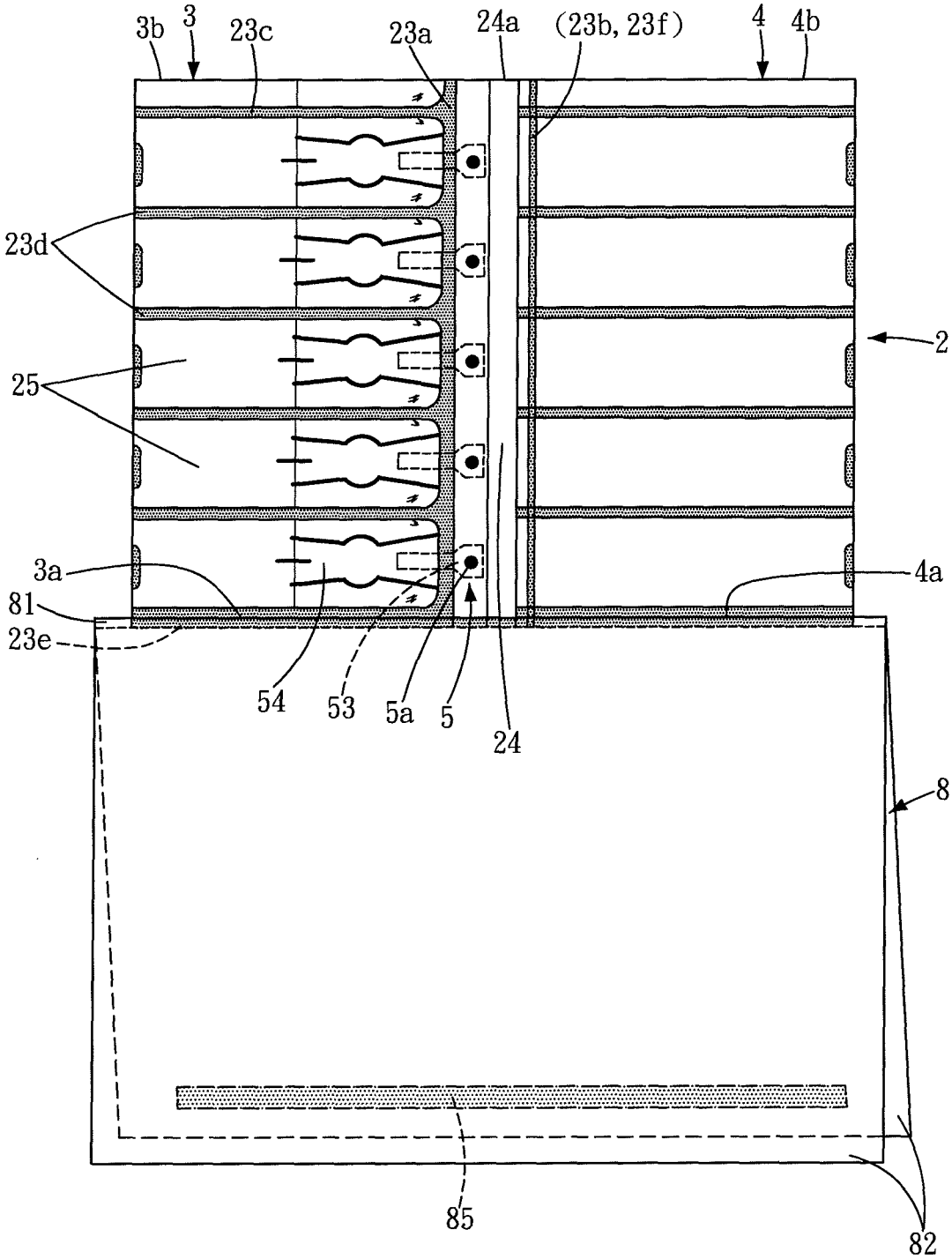
FIG. 10 is the other schematic view of the second preferred embodiment according to the present invention.
Figure 11:
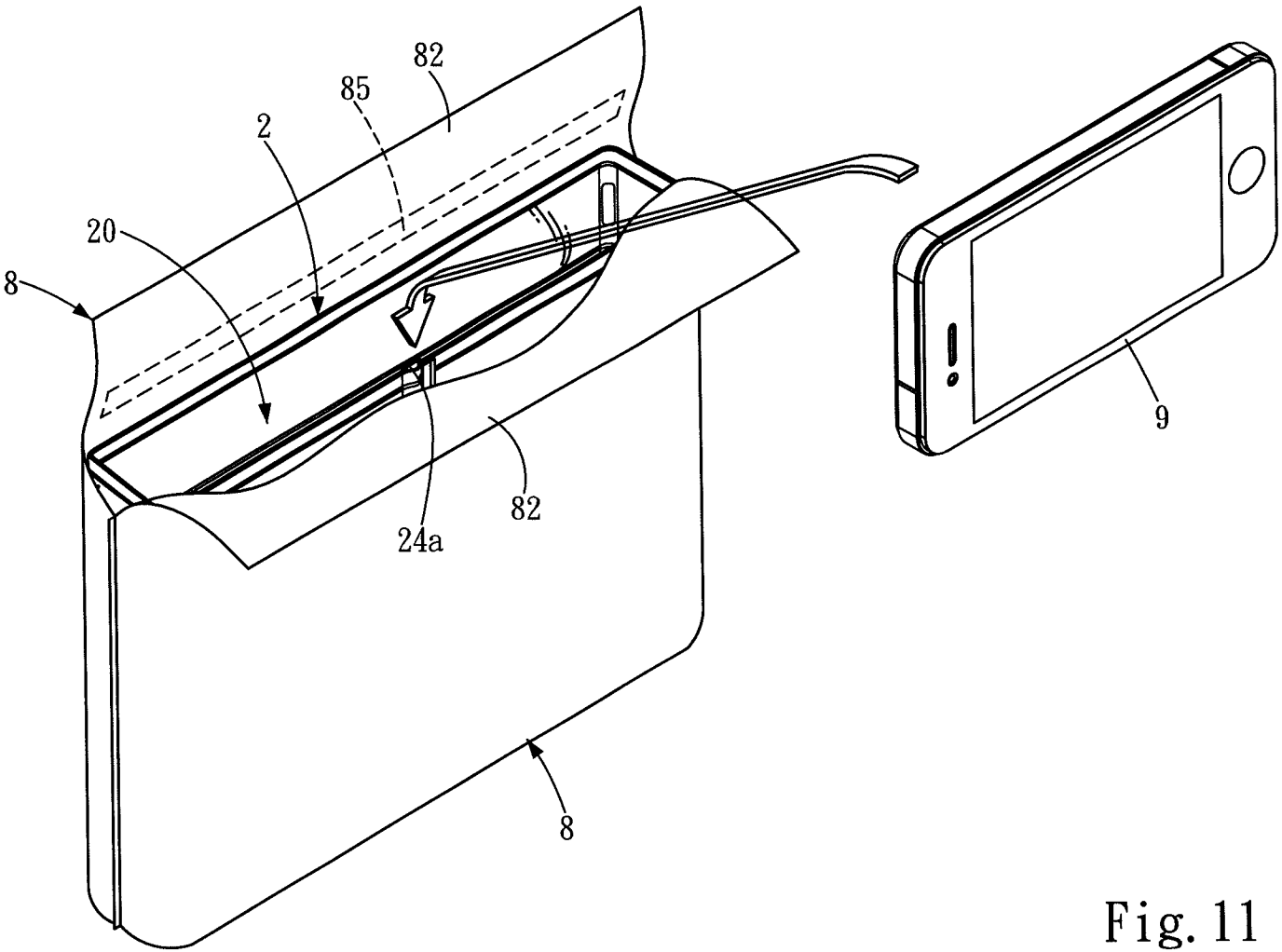
FIG. 11 is a lateral view of the second embodiment of the present while an object is being received.
Figure 12:
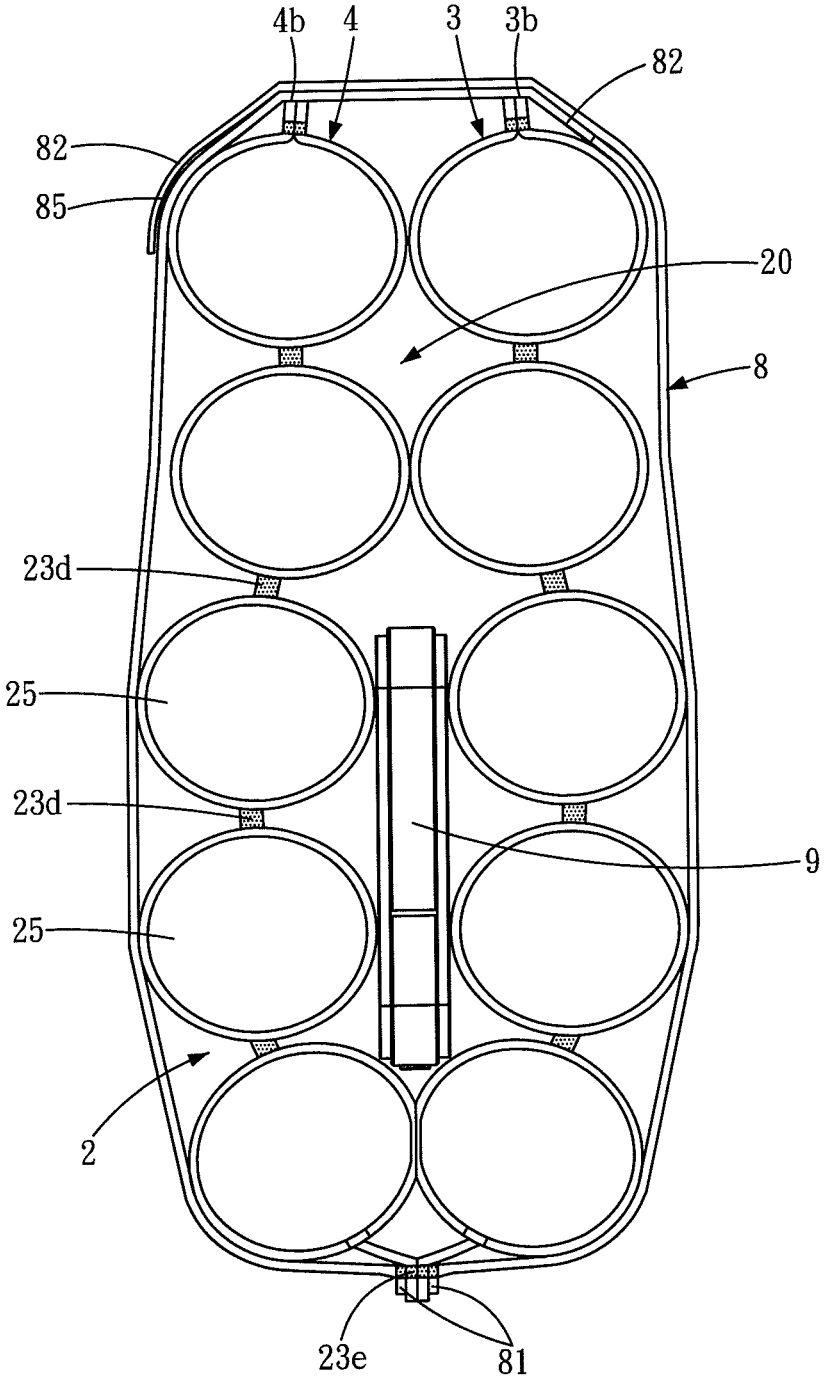
FIG. 12 is a lateral view of the second embodiment of the present invention when an opening is sealed.
Figure 13:
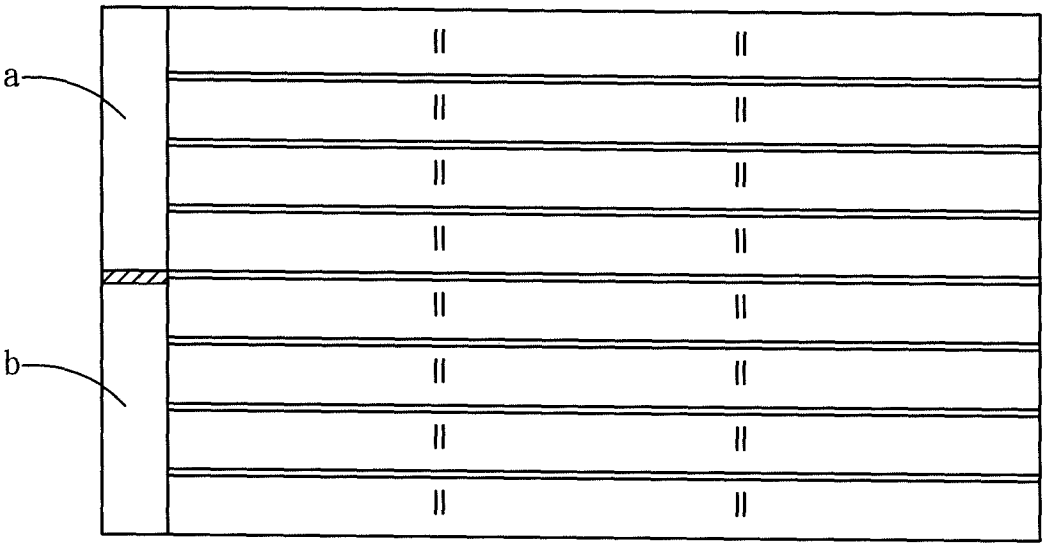
FIG. 13 is a schematic view of a packing bag of a third preferred embodiment according to the present invention configured with an inflatable zone and a non-inflatable zone.
Figure 14:
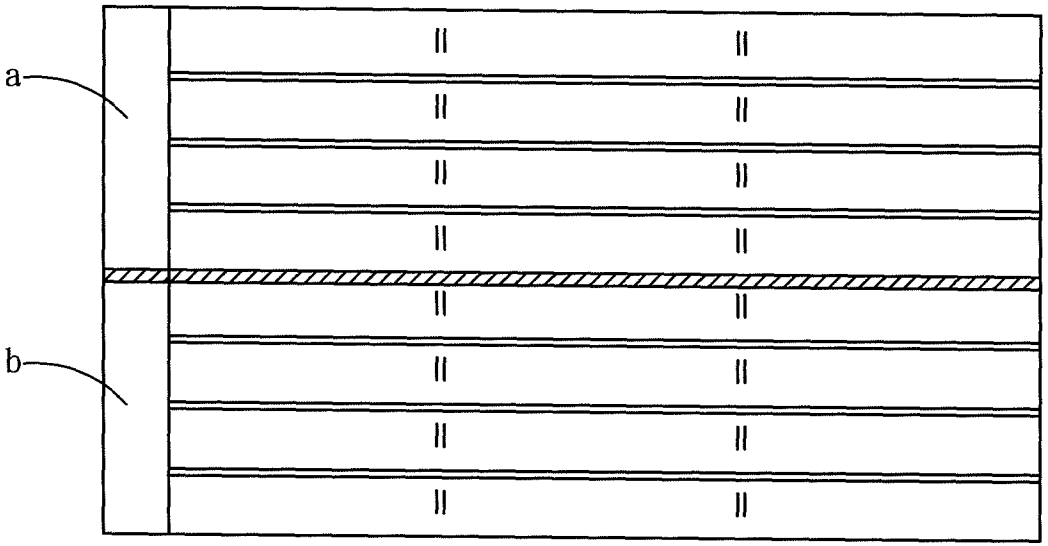
FIG. 14 is another schematic view of a packing bag of the third embodiment according to the present invention configured with an inflatable zone and a non-inflatable zone.
Figure 15:
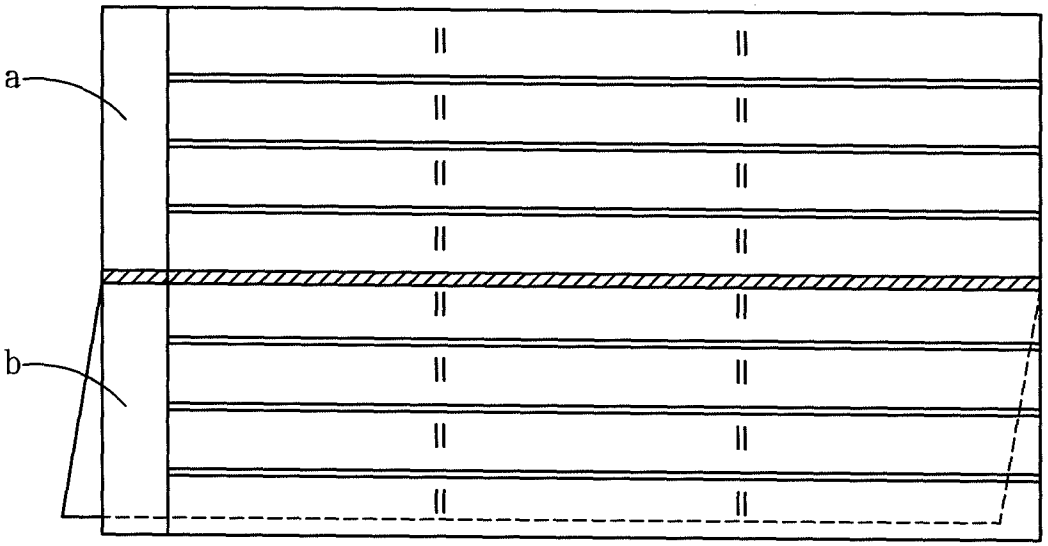
FIG. 15 is a schematic view of a binding belt of the third embodiment according to the present invention.
Figure 16:
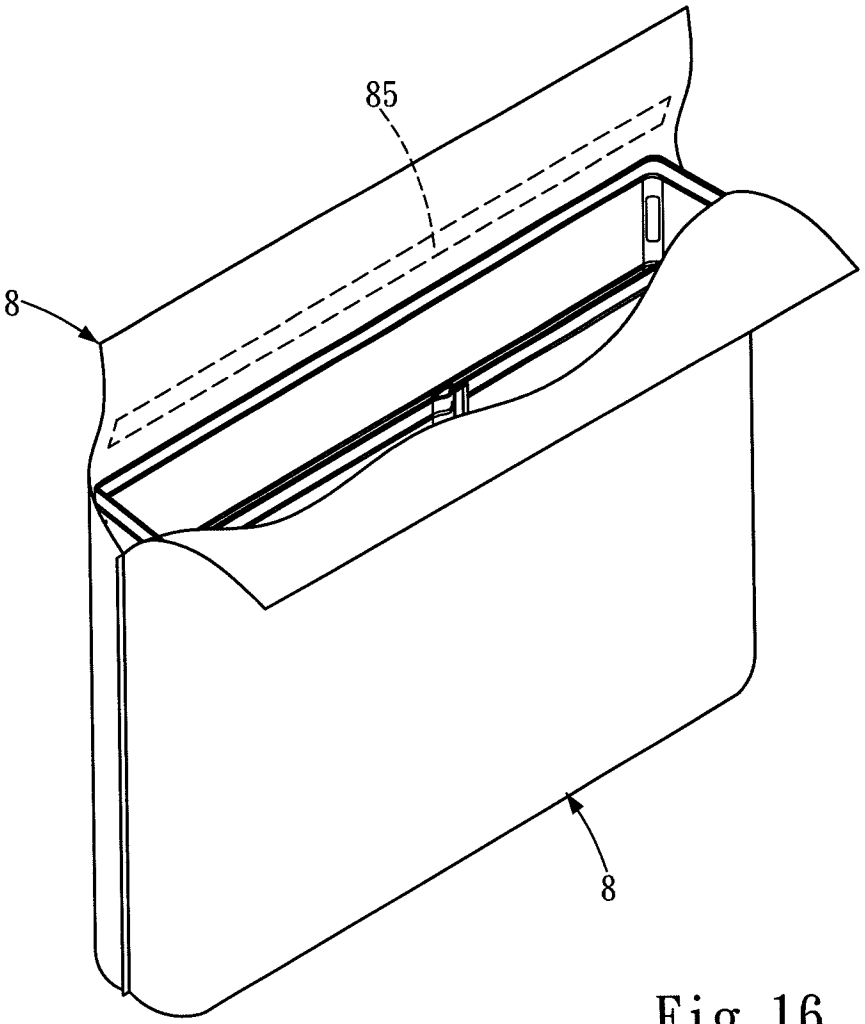
FIG. 16 is a schematic view of a bag formed by a binding belt of the third embodiment according to the present invention.
Figure 17:
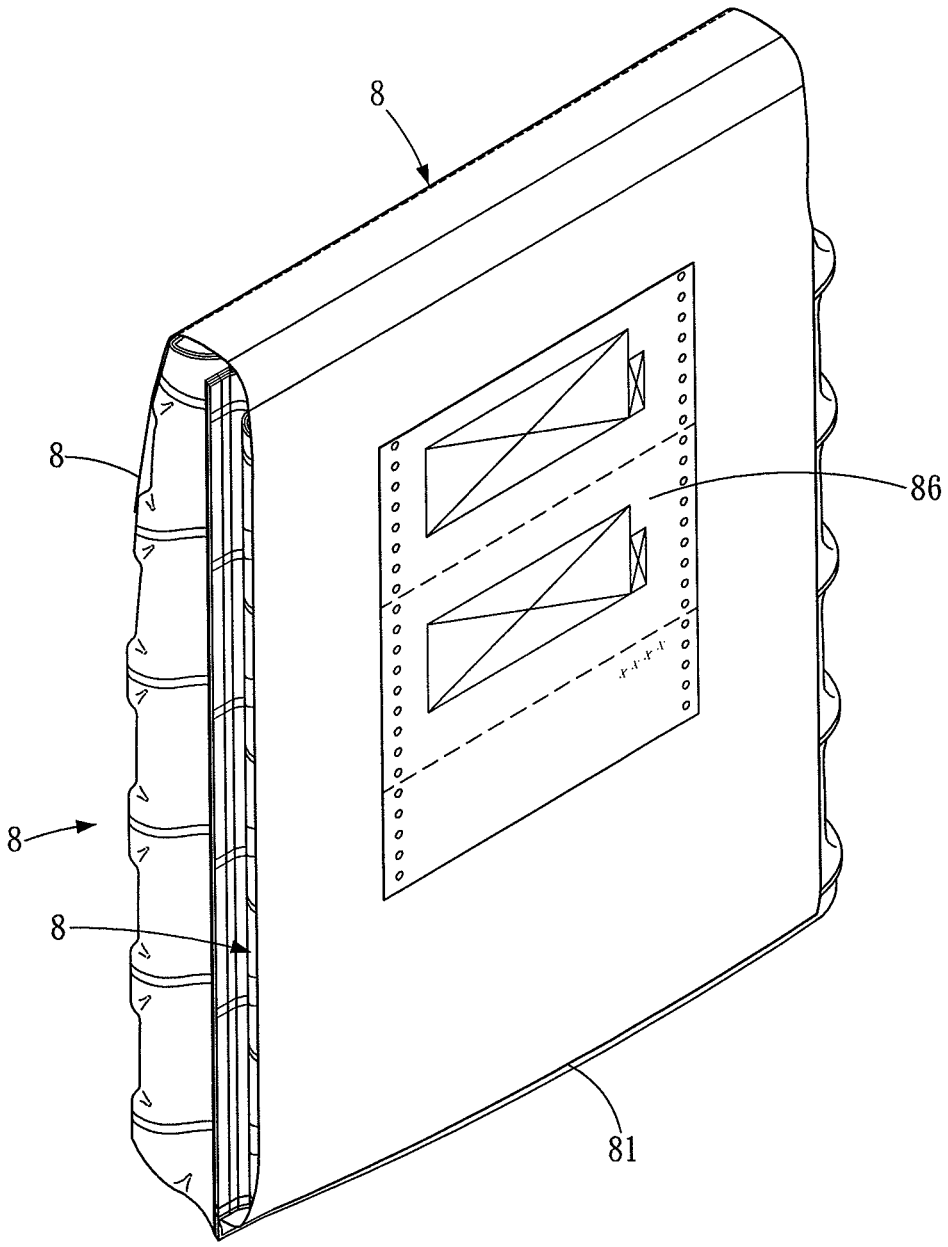
FIG. 17 is a schematic view of a bag of the third embodiment according to the present invention when an opening thereof is sealed.

Please refer to FIG. 5, in which the air cylinder sheet 2 is formed into a bag, and the accepting space, in which an object 9 can be received, is generated between the first cushioning air cylinder portion 3 and second cushioning air cylinder portion 4, referring to FIGS. 5 to 8, a user wraps the binding belt 8 around from the first cushioning air cylinder portion 3 to the second cushioning air cylinder portion 4 after the object 9 is placed in between the first cushioning air cylinder portion 3 and second cushioning air cylinder portion 4, and attaches the positioning end 82 of the binding belt 8 to the second cushioning air cylinder portion 4 through the sticking element 85 of the binding belt 8, thereby shielding the opening 20, preventing the object 9 from escaping out of between the first cushioning air cylinder portion 3 and the second air cylinder portion 4. It should be particularly noted that, as FIG. 8 shows, the user pull the binding belt 8 tightly to cause the top ends of the first cushioning air cylinder portion 3 and second cushioning air cylinder portion 4 (the ends close to the opening 20) to attach to each other closely during the bundling-up process through the binding belt 8. Therefore, the air cylinders 25 will cover the object 9 tightly, and can be prevented from piercing through, thereby preventing the object 9 effectively from being shaken between the first cushioning air cylinder portion 3 and second cushioning air cylinder portion 4 during transportation. Furthermore, the binding belt 8 may be adjusted with the size of the object 9 to stick to other position to bind the first cushioning air cylinder portion 3 and second cushioning air cylinder portion 4 tightly, allowing the air cylinders 25 to cover a different size of object 9 tightly. Therefore, it is unnecessary to change the size of the packing bag 1 even if the size of an object is changed such that the mailing convenience thereof can be improved.

Please refer to FIG. 8,in which in an exemplary embodiment, a label 86 may be disposed on the binding belt 8 on which a user may write or print receiver and sender information, or record transportation matters needing attention, thereby carrying out mailing conveniently.

Please refer to FIGS. 9A to 12, in which the figures show a packing bag with a cushioning function disclosed in a second preferred embodiment according to the present invention. The most obvious difference between the present embodiment and the first embodiment is a binding belt structure. In the present embodiment, the first fixation side 3*a* of the first cushioning air cylinder portion 3 is configured with a binding belt 8, and the second fixation side 4*a* of the second cushioning air cylinder portion 4 is also configured with a binding belt 8 similarly. As mentioned above, the binding belt 8 positioned on the first fixation side 3*a* is wrapped around from the first cushioning air cylinder portion 3 to the second cushioning air cylinder portion 4, allowing the sticking element 85 to attach the positioning end 82 thereof to the second cushioning air cylinder 4, the binding element 8 positioned on the second fixation side 4*a* is wrapped around from the second cushioning air cylinder portion 4 to the first cushioning air cylinder portion 3, allowing the sticking element 85 to attach the positioning end 82 thereof to the other binding belt 8 after the air cylinder sheet 2 is formed into a bag and an object 9 is placed between the first cushioning air cylinder portion 3 and second cushioning air cylinder portion 4, and the object 9 can then be wrapped between the first cushioning air cylinder portion 3 and second cushioning air cylinder portion 4.

The mentioned above does not limit the coupling type of the binding belt 8; the binding belt 8 may also only be secured to the second fixation side 4*a* of the second cushioning air cylinder portion 4 through the fixation end 81, and the binding belt 8 positioned on the second fixation side 4*a* is wrapped around from the second cushioning air cylinder portion 4 to the first cushioning air cylinder portion 3, allowing the sticking element 85 to attach the positioning end 82 thereof to the first cushioning air cylinder portion 3 after the object 9 is placed in between the first cushioning air cylinder portion 3 and second cushioning air cylinder portion 4, thereby shielding the opening 20, preventing the object 9 from escaping out of between the first cushioning air cylinder portion 3 and second cushioning air cylinder portion 4, and avoid the shaking of the object 9 between the first cushioning air cylinder portion 3 and second cushioning air cylinder portion 4 as well.

Please refer to FIGS. 13 to 17, in which the above-mentioned binding belt 8 may also be more than one.

The above-mentioned binding belt 8 may be formed by engaging another plastic film with the first cushioning air cylinder portion 3 and second cushioning air cylinder portion 4;

or, may be formed of a non-inflatable zone configured on a packing bag.

An inflatable zone a and a non-inflatable zone b are configured on the first outer film 21 and the second outer film 22, where the inflatable zone a is formed into the first cushioning air cylinder portion 3 and the second cushioning air cylinder portion 4 by means of hot sealing, and the plastic outer film of the non-inflatable zone b is cut into parts to form the two independent binding belt 8, respectively corresponding to the first cushioning air cylinder portion 3 and second cushioning air cylinder portion 4.

The left sides and right sides of the two binding belts 8 are respectively stuck together by means of hot sealing, and not coupled to the first cushioning air cylinder portion 3 or second cushioning air cylinder portion 4, the bottoms thereof are stuck to the bottoms of the first cushioning air cylinder portion 3 and second cushioning air cylinder 4 to form a loose bag with an opening covering the first cushioning air cylinder portion 3 and second cushioning air cylinder portion 4.

Based on the above, the positioning end may be configured on one of the binding belts 8 at the opening of the bag, and the positioning end may be secured on the other binding belt 8, thereby covering the opening of the bag.

Based on the above, a third binding belt 8 may further be configured, where the third binding belt 8 includes a fixation end 81 and a positioning end 82. The fixation end 81 is coupled to the first fixation side or the second fixation side, i.e. coupled to the bottom of the bag, and the positioning end 82 may be secured on the bag, thereby shielding the opening of the accepting space. Optionally, a label 86 may be configured on the third binding belt 8.

The length and width of the binding belt 8 may all be adjusted voluntarily depending on the measure of are of the first cushioning air cylinder portion 3 or second cylinder air cylinder portion 4.

The material of the binding belt may be PE or PE combined with other different material such as paper, pearl cotton, cloth or cardboard.

The binding belt is a plastic sheet, and a plane itself. A variety of labels can be attached to the plane, thereby facilitating the attachment of mail receiver information.

A packing bag with a cushioning function of the present invention includes an air valve device, used for the air filling to the first cushioning air cylinder portion 3 and second cushioning air cylinder portion 4.

A packing bag with a cushioning function of the present invention includes an air filling passageway 24, which is in air communication with the first cushioning air cylinder portion 3 and the second cushioning air cylinder portion 4 through the air valve device.

In one exemplary embodiment, the air valve device is a continuous check valve 5. The first outer film 21 and second outer film 22 are stuck to each other to form a hot sealing line 23*f*, and thus form the air filling passageway 24 between the first outer film 21 and second outer film 22 at the hot sealing lines 34*a*, 23*f*, where one end of the air filling passageway 24 is provided with an air filling entrance 24*a* as FIG. 4*a* shows.

In one exemplary embodiment, as FIGS. 1 and 4B show, a first inner film 51 and a second inner film 52 may be configured between the first outer film 21 and second outer film 22 to form the continuous check valve 5. The continuous check valve 5 may be configured on the first cushioning air cylinder portion 3, and the first inner film 51 and second inner film 52 are configured in the first outer film 21 and second outer film 22 at a position slightly lower than the top thereof, hot sealing points 5 are generated by means of hot sealing to couple the first outer film 21 to the first inner film 51 and the second outer film 22 to the second inner film 52, and a plurality of positions spaced at a preset distance at the inner surfaces of the first inner film 51 and second inner film 52 are coated with a heat resistant material 53, thereby utilizing the heat resistant material 53 as air passable channels. In addition, the first inner film 51 and second inner channel 52 are stuck to each other by means of hot sealing to form a plurality of air channels 54, where each air cylinder 25 corresponds to at least one air channel 54. Because the first outer film 21 and second outer film 22 are respectively coupled to the first inner film 51 and second inner film 52 through the hot sealing points 5*a* in the air filling passageway 24, the first outer film 21 and second outer film 22 are pulled apart outward by air pressure when air enters the air filling passageway 24 via the air filling entrance 24*a* to cause the air filling entrance 24 to be expanded, the first inner film 51 and second inner film 52 not coupled to each other are driven to pull apart outward through the hot sealing points 5*a*, allowing the air in the air filling entrance 24 is filled into the air cylinders 25 via the air filling channel 24.

The continuous check valve 5 mentioned above is only an example, the present invention is not so limited. The air valve device may also be an independent air valve structure configured on each air cylinder 25 or other air valve structure capable of stopping air flowing out after air is filled in the air cylinder 25. In addition, the air valve structure may be configured on the first cushioning air cylinder portion 3 or second cushioning air cylinder portion 4.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A packing bag with a cushioning function, comprising:

a first cushioning air cylinder portion, constituted by a plurality of air cylinders;

a second cushioning air cylinder portion, constituted by a plurality of air cylinders, and coupled to the first cushioning air cylinder portion to form an accepting space for receiving an object;

a binding belt comprising:

a fixation end coupled to one side of the first cushioning air cylinder portion and/or the second cushioning air cylinder portion away from an opening of the accepting space; and a positioning end secured to the second cushioning air cylinder portion and/or the first cushioning air cylinder portion used for sealing the opening of the accepting space and covering the first cushioning air cylinder portion and/or the second cushioning air cylinder portion, wherein the first cushioning air cylinder portion comprises a first fixation side and a first opening side, the first opening side is positioned at the opening of the accepting space, and the first fixation side is positioned at one end of the first cushioning air cylinder portion opposite to the first opening side, wherein the second cushioning air cylinder portion comprises a second fixation side and a second opening side, the second opening side is positioned at the opening of the accepting space, and the second fixation side is positioned at one end of the second cushioning air cylinder portion opposite to the second opening side, the second fixation side is coupled to the first fixation side, wherein one end on the second cushioning air cylinder portion adjacent to the second opening side is in air communication with the first cushioning air cylinder portion, and another end on the second cushioning air cylinder portion adjacent to the second opening side is coupled to another end of the first cushioning air cylinder portion, and wherein there are two binding belts, the left and right sides of the two binding belts thereof are respectively stuck together by means of hot sealing, bottoms of the two binding belts are all stuck to the first fixation side of the first cushioning air cylinder portion and the second fixation side of second cushioning air cylinder portion, forming a bag to cover the first cushioning air cylinder portion and second cushioning air cylinder portion.

2. The packing bag with a cushioning function according to claim 1, wherein further comprising a third binding belt comprises a fixation end and a positioning end, the fixation end is coupled to the first fixation side or the second fixation side, the positioning end opposite to the fixation end is secured to the second cushioning air cylinder portion or the first cushioning air cylinder portion, thereby sealing the opening of the accepting space, or one of the binding belts at the opening of the bag is disposed with the positioning end.

3. The packing bag with a cushioning function according to claim 1, wherein further comprising a sticking element on one of the two binding belt, used for securing the two binding belt together for sealing the opening of the accepting space.

4. A packing bag with a cushioning function, comprising:

a first cushioning air cylinder portion, constituted by a plurality of air cylinders;

a second cushioning air cylinder portion, constituted by a plurality of air cylinders, and coupled to the first cushioning air cylinder portion to form an accepting space for receiving an object;

a binding belt comprising:

a fixation end coupled to one side of the first cushioning air cylinder portion and/or the second cushioning air cylinder portion away from an opening of the accepting space; and a positioning end secured to the second cushioning air cylinder portion and/or the first cushioning air cylinder portion used for sealing the opening of the accepting space and covering the first cushioning air cylinder portion and/or the second cushioning air cylinder portion, wherein the first cushioning air cylinder portion and the second cushioning air cylinder portion is formed by sticking two sheets of outer film by means of hot sealing after being stacked together, wherein the binding belt is formed by coupling another plastic film to the first cushioning air cylinder portion or the second cushioning air cylinder portion, or formed of a non-inflatable zone configured on the packing bag, and wherein an inflatable zone and the non-inflatable zone are configured on the first cushioning air cylinder portion and the second cushioning air cylinder portion, the inflatable zone forms the first cushioning air cylinder portion and the second cushioning air cylinder portion, a plastic film of the non-inflatable zone is cut apart to form two independent binding belts, respectively corresponding to the first cushioning air cylinder portion and the second cushioning air cylinder portion.

* * * * *